US010049637B2

(12) United States Patent
Lee et al.

(10) Patent No.: US 10,049,637 B2
(45) Date of Patent: Aug. 14, 2018

(54) DISPLAY APPARATUS AND METHOD OF DRIVING THE SAME

(71) Applicant: SAMSUNG DISPLAY CO., LTD., Yongin-si, Gyeonggi-Do (KR)

(72) Inventors: Sang-Ik Lee, Seoul (KR); Kyoung-Ho Lim, Suwon-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 127 days.

(21) Appl. No.: 15/092,158

(22) Filed: Apr. 6, 2016

(65) Prior Publication Data

US 2016/0358576 A1 Dec. 8, 2016

(30) Foreign Application Priority Data

Jun. 3, 2015 (KR) ..... 10-2015-0078653

(51) Int. Cl.
*G09G 5/10* (2006.01)
*G09G 3/36* (2006.01)

(52) U.S. Cl.
CPC ..... *G09G 3/3685* (2013.01); *G09G 3/3674* (2013.01); *G09G 2310/0283* (2013.01); *G09G 2310/08* (2013.01); *G09G 2320/0223* (2013.01); *G09G 2320/0233* (2013.01)

(58) Field of Classification Search
CPC ..... G09G 3/3674; G09G 3/3685; G09G 2310/0283; G09G 2320/0223; G09G 3/3648
USPC ..... 345/99, 100
See application file for complete search history.

(56) References Cited

U.S. PATENT DOCUMENTS 7,777,713 B2 * 8/2010 Hashimoto ..... G09G 3/3648 345/100
2006/0114216 A1 * 6/2006 Shim ..... G09G 3/3677 345/100
2011/0127536 A1 * 6/2011 Yoshida ..... G02F 1/1362 257/59
2013/0314392 A1 * 11/2013 Kim ..... G09G 3/20 345/212
2015/0061985 A1 * 3/2015 Sugiyama ..... G09G 3/3677 345/87
2016/0284297 A1 * 9/2016 Cheng ..... G09G 3/3648

* cited by examiner

*Primary Examiner* — Yuzhen Shen
(74) *Attorney, Agent, or Firm* — F. Chau & Associates, LLC

(57) ABSTRACT

A display apparatus includes a display panel, a data driving part and a gate driving part. The display panel includes data lines extending in a first direction and arranged in a second direction substantially perpendicular to the first direction, and gate lines including a portion extending in the first direction and a portion extending in the second direction. The data driving part is configured to output data signals to the data lines to drive the data lines. The gate driving part is configured to delay original gate signals according to a decrease of a load of the gate line, and output gate signals generated by the delay of the original gate signals to the gate lines to drive the gate lines.

12 Claims, 13 Drawing Sheets

DISPLAY APPARATUS AND METHOD OF DRIVING THE SAME

PRIORITY STATEMENT

This application claims priority under 35 U.S.C. § 119 to Korean Patent Application No. 10-2015-0078653, filed on Jun. 3, 2015 in the Korean Intellectual Property Office (KIPO), the contents of which are herein incorporated by reference in their entireties.

TECHNICAL FIELD

Exemplary embodiments of the present inventive concept relate to a display apparatus and a method of driving the display apparatus.

DESCRIPTION OF THE RELATED ART

A display apparatus such as a liquid crystal display apparatus includes a display panel and a display panel driving apparatus. The display panel includes gate lines and data lines. The display panel driving apparatus includes a gate driving part driving the gate lines, a data driving part driving the data lines, and a timing controlling part controlling a timing of the gate driving part and the data driving part. To display a high quality image luminance deviation of the display panel needs to be minimized. The luminance of the pixels in the display may deviate if the gate or data signals are not synchronized.

SUMMARY

According to an exemplary embodiment of the present inventive concept, a display apparatus includes a display panel, a data driving part and a gate driving part. The display panel includes data lines extending in a first direction and arranged in a second direction substantially perpendicular to the first direction, and n-th gate lines including a portion extending in the first direction and a portion extending in the second direction. The load on the gate lines increases from a first gate line to an n-th gate line. The data driving part outputs data signals to the data lines to drive the data lines. The driving circuit of the gate driving part drives the original gate signals and the delaying circuit of the gate driving part delays the gate signals according to the increasing load of the gate lines, and the gate driving part outputs gate signals generated by the delay of the original gate signals to the gate lines to drive the gate lines.

In an exemplary embodiment, the gate lines may include first to n-th gate lines where portions of the n gate lines extending in the first direction are arranged sequentially in the second direction and portions of the n gate lines extending in the second direction are arranged sequentially in the first direction. Wherein n is a natural number not less than five.

In an exemplary embodiment, the gate driving part may include first to n-th gate driving parts outputting first to n-th gate signals to the first to n-th gate lines. First to (n−1)-th gate driving parts among the first to n-th gate driving parts respectively may include first to (n−1)-th gate driving circuits outputting first to (n−1)-th original gate signals, and first to (n−1)-th gate signal delayers delaying the first to (n−1)-th original gate signals. An n-th gate driving part among the first to n-th gate driving parts may include an n-th gate driving circuit outputting an n-th gate signal.

In an exemplary embodiment, an (n−1)-th gate driving part among the first to (n−1)-th gate driving parts may output an (n−1)-th original gate signal among the first to (n−1)-th original gate signals. An (n−1)-th gate signal delayer among the first to (n−1)-th gate signal delayers may delay the (n−1)-th original gate signal by a first time to output an (n−1)-th gate signal among the first to n-th gate signals. A k-th (k is a natural number not less than three and less than (n−1)) gate driving part among the first to (n−1)-th gate driving parts may output a k-th original gate signal among the first to (n−1)-th original gate signals. A k-th gate signal delayer among the first to (n−1)-th gate signal delayers may delay the k-th original gate signal by a second time longer than the first time to output a k-th gate signal among the first to n-th gate signals.

In an exemplary embodiment, a second gate driving part among the first to (n−1)-th gate driving parts may output a second original gate signal among the first to (n−1)-th original gate signals. A second gate signal delayer among the first to (n−1)-th gate signal delayers may delay the second original gate signal by a third time longer than the second time to output a second gate signal among the first to n-th gate signals.

In an exemplary embodiment, a first gate driving part among the first to (n−1)-th gate driving parts may output a first original gate signal among the first to (n−1)-th original gate signals. A first gate signal delayer among the first to (n−1)-th gate signal delayers may delay the first original gate signal by a fourth time longer than the third time to output a first gate signal among the first to n-th gate signals.

In an exemplary embodiment, the data driving part may delay original data signals according to the decrease of the load of the gate line, and may output the data signals generated by the delay of the original data signals to the data lines.

In an exemplary embodiment, the data lines may include first to m-th (m is a natural number not less than five) data lines. The data driving part may include first to m-th data driving parts outputting first to m-th data signals to the first to m-th data lines. The first to m-th data driving parts may respectively include first to m-th data driving circuits outputting first to m-th original data signals, and first to m-th data signal delayers delaying the first to m-th original data signals according to the load of the gate line.

In an exemplary embodiment, the gate lines may include first to n-th (n is a natural number not less than five) gate lines of which the portions extending in the first direction are arranged in the second direction and the portions extending in the second direction are arranged in the first direction. The portions extending in the first direction of the first to n-th gate lines may increase in a sequence of the first to n-th gate lines.

In an exemplary embodiment, the portions of the gate lines extending in the first direction and the portions of the gate lines extending in the second direction of the first to n-th gate lines make contact points along a diagonal direction of the display panel.

In an exemplary embodiment, the data lines may include first to m-th (m is a natural number not less than five) data lines. The data driving part may include first to m-th data driving parts outputting first to m-th data signals to the first to m-th data lines. The first to m-th data driving parts may respectively include first to m-th data driving circuits outputting first to m-th original data signals, and first to m-th data signal delayers delaying the first to m-th original data signals according to the load of the gate line.

In an exemplary embodiment, when a first gate signal is applied to a first gate line among the first to n-th gate lines and the first gate line is driven, an m-th data driving circuit among the first to m-th data driving circuits may output an m-th original data signal among the first to m-th original data signals, and an m-th data signal delayer among the first to m-th data signal delayers may not delay the m-th original data signal to output an m-th data signal among the first to m-th data signals.

In an exemplary embodiment, an (m−1)-th data driving circuit among the first to m-th data driving circuits may output an (m−1)-th original data signal among the first to m-th original data signals, and an (m−1)-th data signal delayer among the first to m-th data signal delayers may delay the (m−1)-th original data signal by a fifth time to output an (m−1)-th data signal among the first to m-th data signals. A j-th (j is a natural number not less than three and less than (m−1)) data driving circuit among the first to m-th data driving circuits may output a j-th original data signal among the first to m-th original data signals, and a j-th data signal delayer among the first to m-th data signal delayers may delay the j-th original data signal by a sixth time longer than the fifth time to output a j-th data signal among the first to m-th data signals. A second data driving circuit among the first to m-th data driving circuits may output a second original data signal among the first to m-th original data signals, and a second data signal delayer among the first to m-th data signal delayers may delay the second original data signal by a seventh time longer than the sixth time to output a second data signal among the first to m-th data signals. A first data driving circuit among the first to m-th data driving circuits may output a first original data signal among the first to m-th original data signals, and a first data signal delayer among the first to m-th data signal delayers may delay the first original data signal by an eighth time longer than the seventh time to output a first data signal among the first to m-th data signals.

In an exemplary embodiment, when a k-th (k is a natural number not less than three and less than (n−1)) gate signal is applied to a k-th gate line among the first to n-th gate lines and the k-th gate line is driven, a j-th (j is a natural number not less than three and less than (m−1)) data driving circuit among the first to m-th data driving circuits may output a j-th original data signal among the first to m-th original data signals, and a j-th data signal delayer among the first to m-th data signal delayers may not delay the j-th original data signal to output a j-th data signal among the first to m-th data signals.

In an exemplary embodiment, a second data driving circuit among the first to m-th data driving circuits may output a second original data signal among the first to m-th original data signals, and a second data signal delayer among the first to m-th data signal delayers may delay the second original data signal by a ninth time to output a second data signal among the first to m-th data signals. An (m−1)-th data driving circuit among the first to m-th data driving circuits may output an (m−1)-th original data signal among the first to m-th original data signals, and an (m−1)-th data signal delayer among the first to m-th data signal delayers may delay the (m−1)-th original data signal by a tenth time to output an (m−1)-th data signal among the first to m-th data signals. A first data driving circuit among the first to m-th data driving circuits may output a first original data signal among the first to m-th original data signals, and a first data signal delayer among the first to m-th data signal delayers may delay the first original data signal by an eleventh time longer than the ninth time to output a first data signal among the first to m-th data signals. An m-th data driving circuit among the first to m-th data driving circuits may output an m-th original data signal among the first to m-th original data signals, and an m-th data signal delayer among the first to m-th data signal delayers may delay the m-th original data signal by a twelfth time longer than the tenth time to output an m-th data signal among the first to m-th data signals.

In an exemplary embodiment, when an n-th gate signal is applied to an n-th gate line among the first to n-th gate lines and the n-th gate line is driven, a first data driving circuit among the first to m-th data driving circuits may output a first original data signal among the first to m-th original data signals, and a first data signal delayer among the first to m-th data signal delayers may not delay the first original data signal to output a first data signal among the first to m-th data signals.

In an exemplary embodiment, a second data driving circuit among the first to m-th data driving circuits may output a second original data signal among the first to m-th original data signals, and a second data signal delayer among the first to m-th data signal delayers may delay the second original data signal by a thirteenth time to output a second data signal among the first to m-th data signals. A j-th (j is a natural number not less than three and less than (m−1)) data driving circuit among the first to m-th data driving circuits may output a j-th original data signal among the first to m-th original data signals, and a j-th data signal delayer among the first to m-th data signal delayers may delay the j-th original data signal by a fourteenth time longer than the thirteenth time to output a j-th data signal among the first to m-th data signals. An (m−1)-th data driving circuit among the first to m-th data driving circuits may output an (m−1)-th original data signal among the first to m-th original data signals, and an (m−1)-th data signal delayer among the first to m-th data signal delayers may delay the (m−1)-th original data signal by a fifteenth time longer than the fourteenth time to output an (m−1)-th data signal among the first to m-th data signals. An m-th data driving circuit among the first to m-th data driving circuits may output an m-th original data signal among the first to m-th original data signals, and an m-th data signal delayer among the first to m-th data signal delayers may delay the m-th original data signal by a sixteenth time longer than the fifteenth time to output an m-th data signal among the first to m-th data signals.

In an exemplary embodiment, the data driving part and the gate driving part may be disposed at the same side of the display panel.

According to an exemplary embodiment of the present inventive concept, a method of driving a display apparatus includes driving data lines by outputting data signals to the data lines of a display panel including the data lines extending in a first direction and arranged in a second direction substantially perpendicular to the first direction and n-th gate lines including a portion extending in the first direction and a portion extending in the second direction. The load on the n-th gate lines decreases from a n-th gate line to an first gate line. The original gate signals are delayed according to a decrease of a load of the gate line and outputting the gate signals generated by the delay of the original gate signals to the gate lines.

In an exemplary embodiment, the driving the data lines may include delaying original data signals according to the decrease of the load of the gate line, and outputting the data signals generated by the delay of the original data signals to the data lines.

In an exemplary embodiment, a display apparatus may include a display panel a gate driving part and a data driving part. A gate driving part is connected to n vertical gate lines and the n vertical gate lines are extended in a horizontal direction. N is a natural number not less than five. The load on the n gate lines increases from a first gate line to an n-th gate line. The gate driving part delays the gate signals according to the increasing load of the gate lines and outputs the delayed gate signal to the gate lines. A data driving part, adjacent to the gate driving part, may be connected to m vertical data lines. The data driving part outputs data signals to the m data lines. M is a natural number not less than five.

An exemplary embodiment of the data driving part delays the m data signals according to a decreasing load of the n gate lines.

According to an exemplary embodiment a first through (n−1)-th gate driving part comprises a gate driving circuit to output an original gate signal, the original gate driving signal is transmitted to a gate signal delayer. The gate signal delayer delays the original gate signal and the gate driving part outputs the delayed gate signal. The n gate driving part comprises a gate driving circuit to output an original gate signal.

An exemplary embodiment discloses a first through m data driving part comprises a data driving circuit to output an original data signal. The original data driving signal is transmitted to a data signal delayer. The data signal delayer delays the original data signal and the data driving part outputs the delayed data signal.

BRIEF DESCRIPTION OF THE DRAWINGS

The above and other features of the present inventive concept will become more apparent by describing in detailed example embodiments thereof with reference to the accompanying drawings, in which.

DETAILED DESCRIPTION

Hereinafter, the present inventive concept will be explained in detail with reference to the accompanying drawings.

Figure 1:
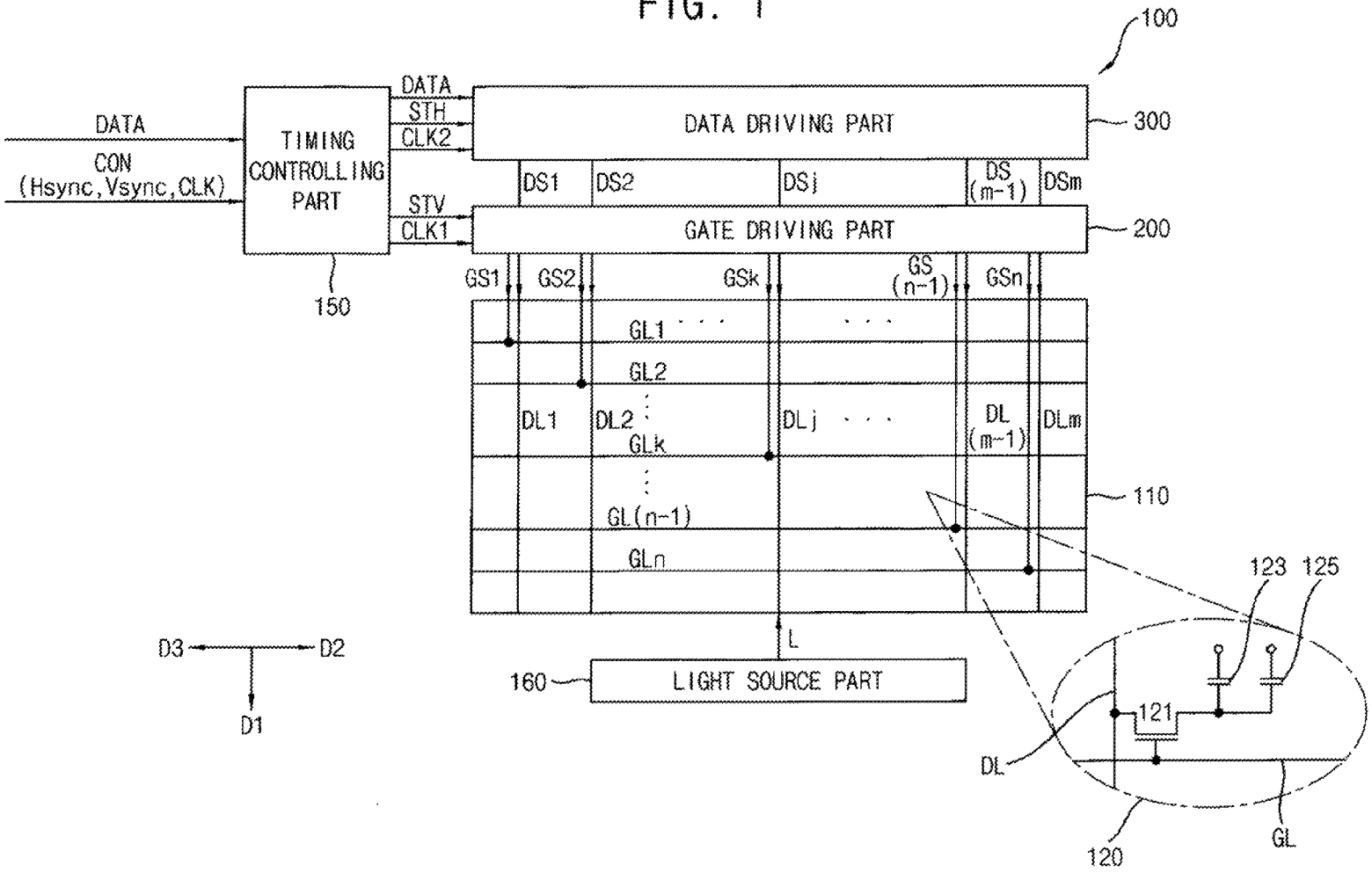
FIG. 1 is a block diagram illustrating a display apparatus according to an exemplary embodiment of the present inventive concept.

FIG. 1 is a block diagram illustrating a display apparatus according to an exemplary embodiment of the present inventive concept.

Referring to FIG. 1, the display apparatus 100 according to the present exemplary embodiment includes a display panel 110, a gate driving part 200, a data driving part 300, a timing controlling part 150 and a light source part 160.

The display panel 110 receives data signals DS1, DS2, . . . , DSj, . . . , DS(m−1) and DSm, where m is a natural number not less than five, based on an image data DATA provided from the timing controlling part 150 to display an image. The display panel 110 may include n (n is a natural number not less than five) gate lines GL1, GL2, . . . , GLk (k is a natural number not less than three and less than (n−1)), . . . , GL(n−1) and GLn, m data lines DL1, DL2, . . . , DLj (j is a natural number not less than three and less than (m−1)), . . . , DL(m−1) and DLm, and a plurality of pixels 120. The data lines DL1, DL2, . . . , DLj, . . . , DL(m−1) and DLm extend in a first direction D1 and are further arranged in a second direction D2 substantially perpendicular to the first direction D1. Each of the gate lines GL1, GL2, . . . , GLk, . . . , GL(n−1) and GLn includes a portion extending in the first direction D1 and a portion extending in a second direction D2 substantially perpendicular to the first direction D1. The portions extending in the first direction D1 in the gate lines GL1, GL2, . . . , GLk, . . . , GL(n−1) and GLn may be respectively adjacent to the data lines DL1, DL2, . . . , DLj, . . . , DL(m−1) and DLm. In addition, a k-th gate line GLK among the gate lines GL1, GL2, . . . , GLk, . . . , GL(n−1) and GLn may be adjacent to a central area of the display panel 110 in the first direction D1. In addition, a j-th data line DLj among the data lines DL1, DL2, . . . , DLj, . . . , DL(m−1) and DLm may be adjacent to the central area of the display panel 110 in the second direction D2. Thus, a point where the k-th gate line GLk and the j-th data line DLj intersect may be adjacent to the central area of the display panel 110.

In the gate lines, GL1, GL2, . . . , GLk, . . . , GL(n−1) and GLn, the portions extending in the first direction D1 are arranged in the second direction D2 and the portions extending in the second direction D2 are arranged in the first direction D1. Contact points where the portions extending in the first direction D1 of the gate lines GL1, GL2, . . . , GLk, . . . , GL (n−1) and GLn and the portions extending in the second direction D2 of the gate lines GL1, GL2, . . . , GLk, . . . , GL (n−1) and GLn make contact may be disposed along a diagonal direction between the first direction D1 and the second direction D2. Due to the combination of line length and capacitive effects, the loads of the gate lines GL1, GL2, . . . , GLk, . . . , GL(n−1) and GLn as seen from the driving part tend to increase along the direction of the gate lines from GL1, GL2, . . . , GLk, . . . , GL(n−1) to GLn.

For example, the display panel 110 may be a liquid crystal display panel. Thus, the pixel 120 may include a thin film transistor 123 electrically connected to the gate line GL and the data line DL, a liquid crystal capacitor 123 and a storage capacitor 125 electrically connected to the thin film transistor 121. Here, the gate line GL may be one among the gate lines GL1, GL2, . . . , GLk, . . . , GL(n−1) and GLn. In addition, the data line DL may be one among the data lines DL1, DL2, . . . , DLj, . . . , DL(m−1) and DLm.

The gate driving part 200, the data driving part 300 and the timing controlling part 150 may be defined as a display panel driving apparatus driving the display panel 110.

The gate driving part 200 generates gate signals GS1, GS2, . . . , GSk, . . . , GS(n−1) and GSn in response to a gate start signal STV and a gate clock signal CLK1 provided from the timing controlling part 150, and outputs the gate signals GS1, GS2, GSk, GS(n−1) and GSn to the gate line GL1, GL2, . . . , GLk, . . . , GL(n−1) and GLn, respectively. Here, the gate driving part 200 may be disposed at the upper side of the display panel 110. In this case, the gate driving part 200 may output the gate signals GS1, GS2, . . . , GSk, . . . , GS(n−1) and GSn to the portions extending in the first direction D1 of the gate line GL1, GL2, . . . , GLk, . . . , GL(n−1) and GLn.

The gate driving part 200 delays original gate signals of the gate signals GS1, GS2, . . . , GSk, . . . , GS(n−1) and GSn in consideration of loads of the gate line GL1, GL2, . . . , GLk, . . . , GL(n−1) and GLn to output the gate signals GS1, GS2, . . . , GSk, . . . , GS(n−1) and GSn to the gate line GL1, GL2, . . . , GLk, . . . , GL(n−1) and GLn. The gate driving part 200 may delay the original gate signals of the gate signals GS1, GS2, . . . , GSk, . . . , GS(n−1) and GSn according to a decrease of the loads of the gate line GL1, GL2, . . . , GLk, . . . , GL(n−1) and GLn.

For example, the load of the gate lines increases from the first gate line GL1 to the second gate line GL2 to the k-th gate line GLk to the (n−1)-th gate line GL(n−1) to the n-th gate line GLn. The gate driving part does not delay the n-th original gate signal GSn. The gate driving part 200 delays the (n−1)-th original gate signal GS (n−1) by a first time to output the (n−1)-th gate signal GS (n−1). The gate driving part 200 delays the k-th original gate signal GSk by a second time, where the second time is longer than the first time, to output the k-th gate signal GSk. The gate driving part 200 delays the second original gate signal GS2 by a third time, where the third time is longer than the second time, to output the second gate signal GS2. The gate driving part 200 delays the first original gate signal GS1 by a fourth time, where the fourth time is longer than the third time, to output the first gate signal GS1.

The data driving part 300 converts the image data DATA provided from the timing controlling part 150 into the data signals DS1, DS2, . . . , DSj, . . . , DS(m−1) and DSm. The data driving part 300 respectively outputs the data signals DS1, DS2, . . . , DSj, . . . , DS(m−1) and DSm to the data lines DL1, DL2, . . . , DLj, . . . , DL(m−1) and DLm in response to receiving a data start signal STH and a data clock signal CLK2 provided from the timing controlling part 150. Here, the data driving part 300 may be disposed at the upper side of the display panel 110. Thus, the gate driving part 200 and the data driving part 300 may be disposed at the same side of the display panel 110.

The data driving part 300 delays the output of the original data signals DS1, DS2, . . . , DSj, . . . , DS(m−1) and DSm to the data lines DL1, DL2, . . . , DLj, . . . , DL(m−1) and DLm in response to the load on the gate lines GL1, GL2, . . . , GLk, . . . , GL(n−1) and GLn. The data driving part 300 may delay the original data signals of the data signals DS1, DS2, . . . , DSj, . . . , DS(m−1) and DSm according to the decrease of the load of the gate lines GL1, GL2, . . . , GLk, . . . , GL(n−1) and GLn.

For example, when the first gate signal GS1 is applied to the first gate line GL1 and thus the first gate line GL1 is driven, a load of the first gate line GL1 may increase in the second direction D2 based on a first data line DL1 adjacent to the first gate line GL1. The data driving part 300 may delay some of the data signals DS1, DS2, . . . , DSj, . . . , DS(m−1) and DSm based on a load of the first gate line GL1. The data driving part 300 may not delay an m-th original data signal of an m-th data signal DSm to output the m-th data signal DSm. However, the data driving part 300 may delay the output of an (m−1)-th original data signal DS(m−1) by a fifth time and may delay a j-th original data signal DSj by a sixth time which is longer than the fifth time. Furthermore, the data driving part 300 may delay the output of a second original data signal DS2 by a seventh time which is longer than the sixth time and may delay a first original data signal DS1 by an eighth time which is longer than the seventh time.

In addition, when the k-th gate signal GSk is applied to the k-th gate line GLk and thus the k-th gate line GLk is driven, a load of the k-th gate line GLk may increase in both directions relative to the j-th data line DLj adjacent to the k-th gate line GLk. When the k-th gate line GLk is driven, the load of the k-th gate line GLk may increase in the second direction D2 and a third direction D3 opposed to the second direction D2 relative to the j-th data line DLj. Therefore, the data driving part 300 may not delay the output of the j-th original data signal DSj. The data driving part 300 may delay the output of the second original data signal DS2 by a ninth time and may delay the output of the (m−1)-th original data signal DS(m−1) by a tenth time. Furthermore, the data driving part 300 may delay the output of the first original data signal DS1 by an eleventh time which is longer than the ninth time and may delay the output of the m-th original data signal DSm during a twelfth time which is longer than the tenth time.

In addition, when the n-th gate signal GSn is applied to the n-th gate line GLn and thus the n-th gate line GLn is driven, a load of the n-th gate line GLn may increase in the third direction D3 relative to the m-th data line DLm adjacent to the n-th gate line GLn. Therefore, the data driving part 300 may not delay the output of the first original data signal DS1. However, the data driving part 300 may delay the output of the second original data signal DS2 by a thirteenth time and may delay the output of the j-th original data signal DSj by a fourteenth time longer than the thirteenth time. The data driving part 300 may delay the output of the (m−1)-th original data signal DS(m−1)-th by a fifteenth time which is longer than the fourteenth time and may delay the output of the m-th original data signal DSm during a sixteenth time which is longer than the fifteenth time.

The timing controlling part 150 receives the image data DATA and a control signal CON from an outside source. The control signal CON may include a horizontal synchronous signal Hsync, a vertical synchronous signal Vsync and a clock signal CLK. The timing controlling part 150 generates the data start signal STH using the horizontal synchronous signal Hsync and outputs the data start signal STH to the data driving part 300. In addition, the timing controlling part 150 generates the gate start signal STV using the vertical synchronous signal Vsync and outputs the gate start signal STV to the gate driving part 200. In addition, the timing controlling part 150 generates the gate clock signal CLK1 and the data clock signal CLK2 using the clock signal CLK, outputs the gate clock signal CLK1 to the gate driving part 200, and outputs the data clock signal CLK2 to the data driving part 300.

The light source part 160 provides light L to the display panel 110. For example, the light source part 160 may include a Light Emitting Diode (LED).

Figure 2:
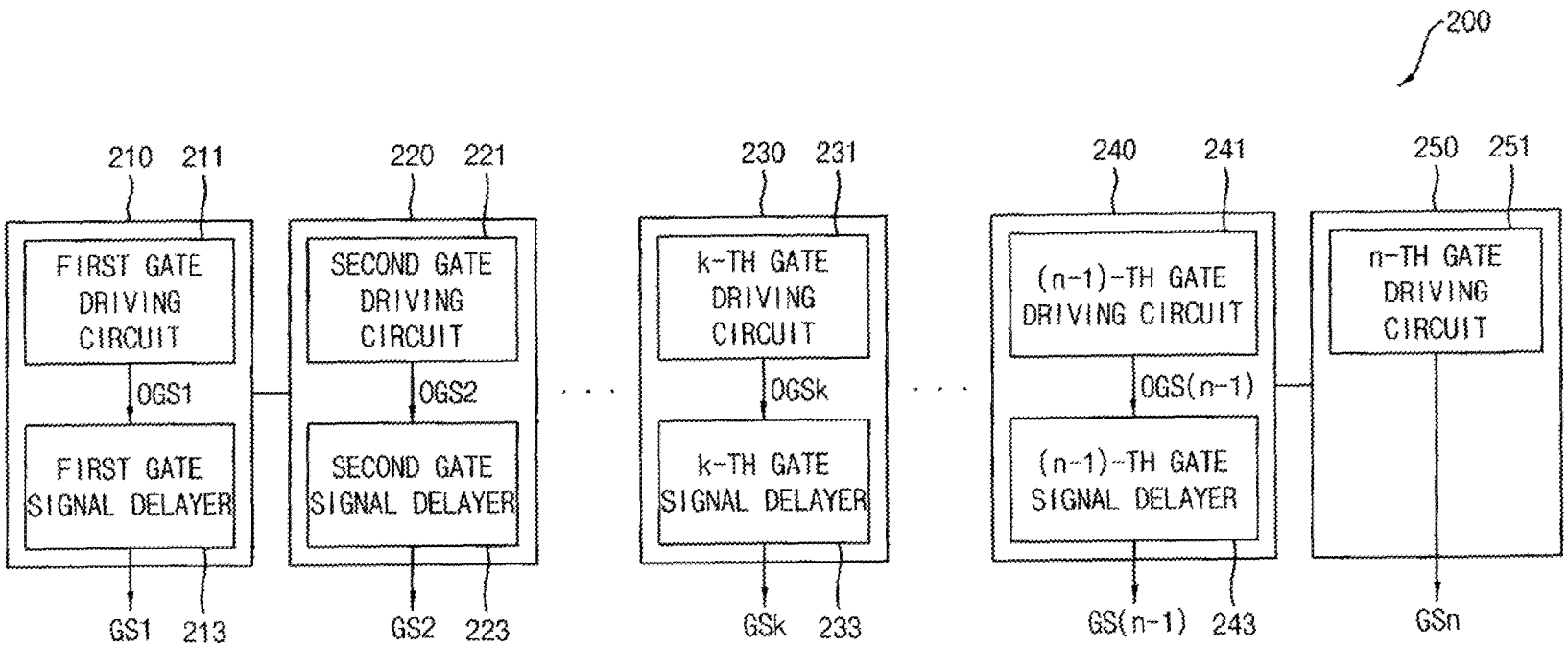
FIG. 2 is a block diagram illustrating a gate driving part of FIG. 1.

FIG. 2 is a block diagram illustrating the gate driving part 200 of FIG. 1.

Referring to FIGS. 1 and 2, the gate driving part 200 may include a first gate driving part 210, a second gate driving part 220, a k-th gate driving part 230, a (n−1)-th gate driving part 240 and an n-th gate driving part 250.

The first gate driving part 210 outputs the first gate signal GS1. The first gate driving part 210 may include a first gate driving circuit 211 and a first gate signal delayer 213. The first gate driving circuit 211 outputs a first original gate signal OGS1. The first gate signal delayer 213 delays the first original gate signal OGS1 according to a load of the first gate line GL1 to output the first gate signal GS1.

The second gate driving part 220 outputs the second gate signal GS2. The second gate driving part 220 may include a second gate driving circuit 221 and a second gate signal delayer 223. The second gate driving circuit 221 outputs a second original gate signal OGS2. The second gate signal delayer 223 delays the second original gate signal OGS2 according to a load of the second gate line GL2 to output the second gate signal GS2.

The k-th gate driving part 230 outputs the k-th gate signal GSk. The k-th gate driving part 230 may include a k-th gate driving circuit 231 and a k-th gate signal delayer 233. The k-th gate driving circuit 231 outputs a k-th original gate signal OGSk. The k-th gate signal delayer 233 delays the k-th original gate signal OGSk according to a load of the k-th gate line GLk to output the k-th gate signal GSk.

The (n−1)-th gate driving part 240 outputs the (n−1)-th gate signal GS(n−1). The (n−1)-th gate driving part 240 may include an (n−1)-th gate driving circuit 241 and an (n−1)-th gate signal delayer 243. The (n−1)-th gate driving circuit 241 outputs an (n−1)-th original gate signal OGS(n−1). The (n−1)-th gate signal delayer 243 delays the (n−1)-th original gate signal OGS(n−1) according to a load of the (n−1)-th gate line GLk to output the (n−1)-th gate signal GS(n−1).

The n-th gate driving part 250 outputs the n-th gate signal GSn. The n-th gate driving part 250 may include an n-th gate driving circuit 251. The n-th gate driving circuit 251 outputs the n-th gate signal GSk.

Figure 3A:
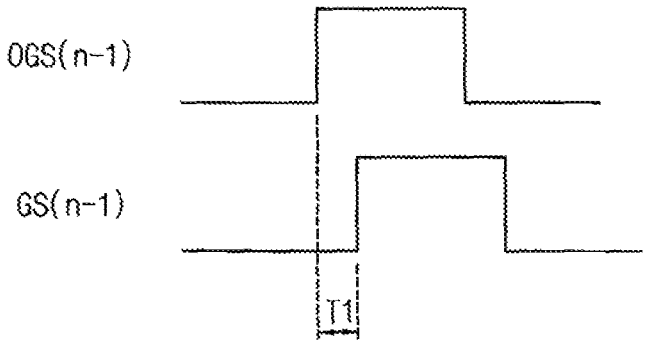
FIG. 3A is a waveform diagram illustrating an (n−1)-th original gate signal and an (n−1)-th gate signal of FIG. 2.
Figure 3B:
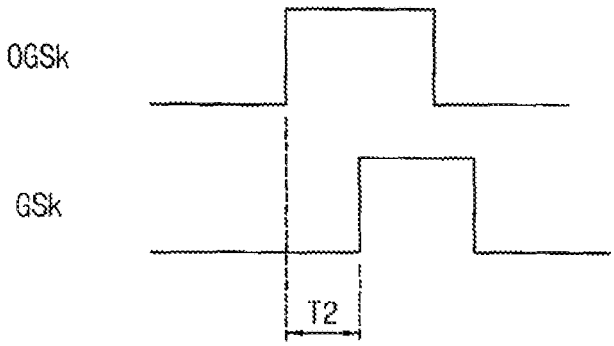
FIG. 3B is a waveform diagram illustrating a k-th original gate signal and a k-th gate signal of FIG. 2.
Figure 3C:
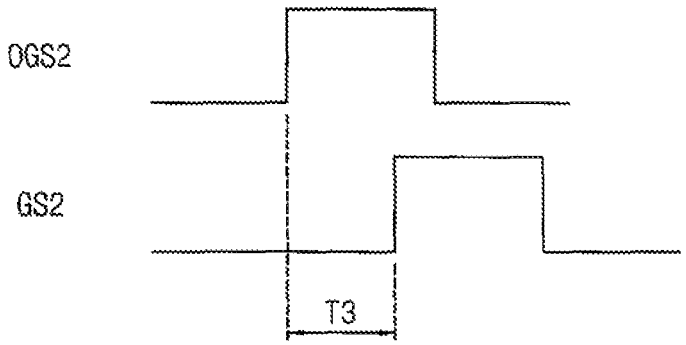
FIG. 3C is a waveform diagram illustrating a second original gate signal and a second gate signal of FIG. 2.
Figure 3D:
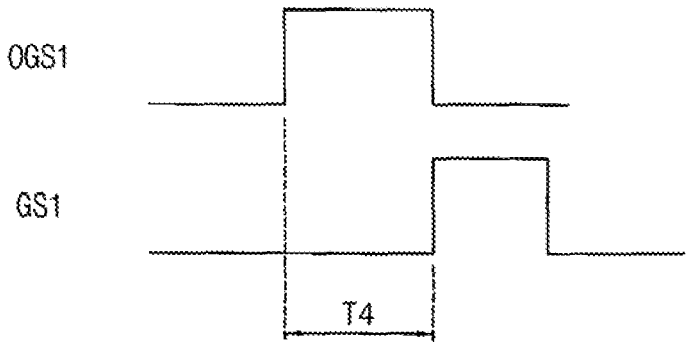
FIG. 3D is a waveform diagram illustrating a first original gate signal and a first gate signal of FIG. 2.

FIG. 3A is a waveform diagram illustrating the (n−1)-th original gate signal OGS(n−1) and the (n−1)-th gate signal GS(n−1) of FIG. 2. FIG. 3B is a waveform diagram illustrating the k-th original gate signal OGSk and the k-th gate signal GSk of FIG. 2. FIG. 3C is a waveform diagram illustrating the second original gate signal OGS2 and the second gate signal GS2 of FIG. 2. FIG. 3D is a waveform diagram illustrating the first original gate signal OGS1 and the first gate signal GS1 of FIG. 2.

Referring to FIGS. 1 to 3D, since the load of the n-th gate line GLn is the greatest, among the loads of the gate lines GL1, GL2, . . . , GLk, . . . , GL(n−1) and GLn, the n-th gate driving part 250 outputs the n-th gate signal GSn without a delay procedure.

Since the load of the (n−1)-th gate line GL(n−1) is less than that of the n-th gate line GLn, the (n−1)-th gate signal delayer 243 of the (n−1)-th gate driving part 240 delays the (n−1)-th original gate signal OGS(n−1), which is output from the (n−1)-th gate driving circuit 241, by a first time T1 to output the (n−1)-th gate signal GS(n−1).

Since the load of the k-th gate line GLk is less than that of the (n−1)-th gate line GL(n−1), the k-th gate signal delayer 233 of the k-th gate driving part 230 delays the k-th original gate signal OGSk, which is output from the k-th gate driving circuit 231, by a second time T2 longer than the first time T1 to output the k-th gate signal GSk.

Since the load of the second gate line GL2 is less than that of the k-th gate line GLk, the second gate signal delayer 223 of the second gate driving part 220 delays the second original gate signal OGS2, which is output from the second gate driving circuit 221, by a third time T3 longer than the second time T2 to output the second gate signal GS2.

Since the load of the first gate line GL1 is less than that of the second gate line GL2, the first gate signal delayer 213 of the first gate driving part 210 delays the first original gate signal OGS1, which is output from the first gate driving circuit 211, by a fourth time T4 longer than the third time T3 to output the first gate signal GS1.

In the present exemplary embodiment, the n-th gate driving circuit 251 of the n-th gate driving part 250 directly outputs the n-th gate signal GSn, but is not limited thereto. For example, the n-th gate driving part 250 may further include an n-th gate signal delayer (not shown), the n-th gate driving circuit 251 may output an n-th original gate signal of the n-th gate signal GSn, and the n-th gate signal delayer (not shown) may delay the n-th original gate signal to output the n-th gate signal GSn. In this case, since the load of the n-th gate line GLn is greater than that of the (n−1)-th gate line GL(n−1), the n-th gate signal delayer (not shown) of the n-th gate driving part 250 may delay the n-th original gate signal, which is output from the n-th gate driving circuit 251, during a time shorter than the first time T1 to output the n-th gate signal GSn.

Figure 4:
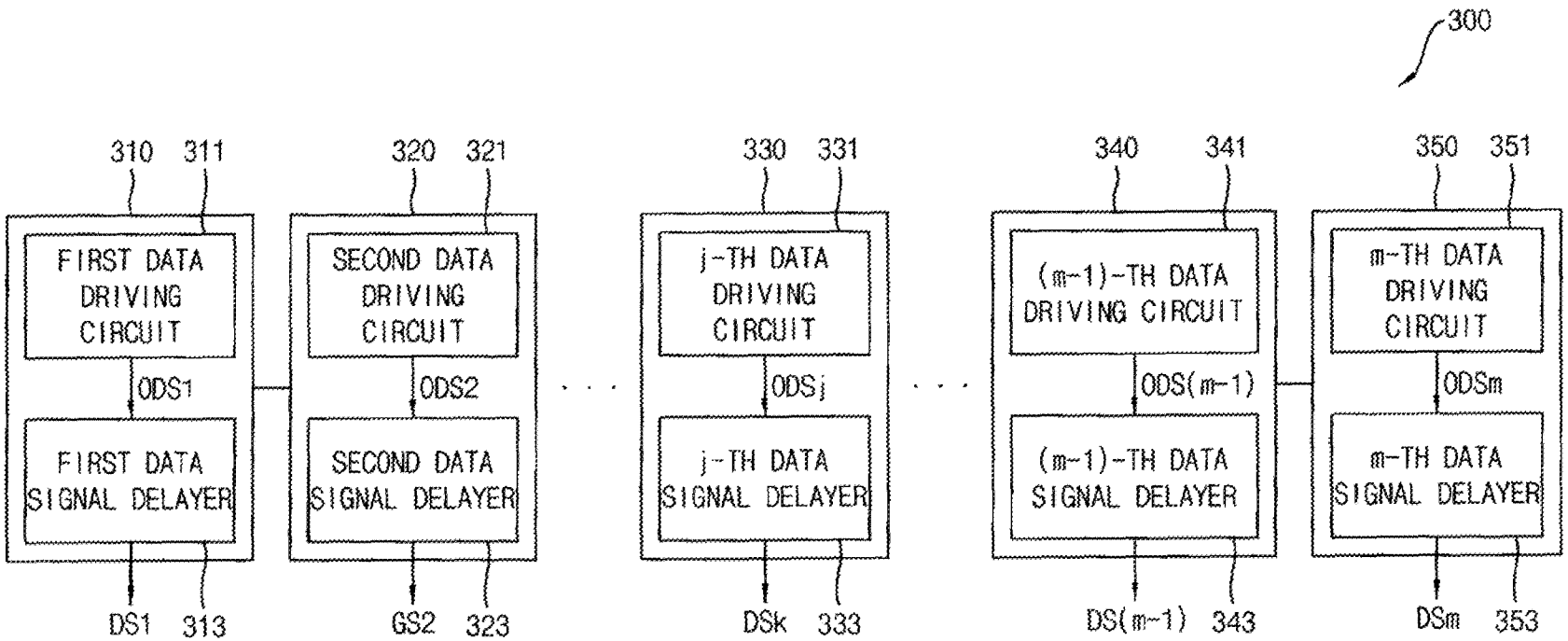
FIG. 4 is a block diagram illustrating a data driving part of FIG. 1.

FIG. 4 is a block diagram illustrating the data driving part 300 of FIG. 1.

Referring to FIGS. 1 to 4, the data driving part 300 may include a first data driving part 310, a second data driving part 320, a j-th data driving part 330, an (m−1)-th data driving part 340 and an m-th data driving part 350.

The first data driving part 310 outputs the first data signal DS1. The first data driving part 310 may include a first data driving circuit 311 and a first data signal delayer 313. The first data driving circuit 311 outputs a first original data signal ODS1. The first data signal delayer 313 delays the first original data signal ODS1 according to the loads of the gate signals GL1, GL2, . . . , GLk, . . . , GL(n−1) and GLn to output the first data signal DS1.

The second data driving part 320 outputs the second data signal DS2. The second data driving part 320 may include a second data driving circuit 321 and a second data signal delayer 323. The second data driving circuit 321 outputs a second original data signal ODS2. The second data signal delayer 323 delays the second original data signal ODS2 according to the loads of the gate signals GL1, GL2, . . . , GLk, . . . , GL(n−1) and GLn to output the second data signal DS2.

The j-th data driving part 330 outputs the j-th data signal DSj. The j-th data driving part 330 may include a j-th data driving circuit 331 and a j-th data signal delayer 333. The j-th data driving circuit 331 outputs a j-th original data signal ODSj. The j-th data signal delayer 333 delays the j-th original data signal ODSj according to the loads of the gate signals GL1, GL2, . . . , GLk, . . . , GL(n−1) and GLn to output the j-th data signal DSj.

The (m−1)-th data driving part 340 outputs the (m−1)-th data signal DS(m−1). The (m−1)-th data driving part 340 may include an (m−1)-th data driving circuit 341 and an (m−1)-th data signal delayer 343. The (m−1)-th data driving circuit 341 outputs an (m−1)-th original data signal ODS (m−1). The (m−1)-th data signal delayer 343 delays the (m−1)-th original data signal ODS(m−1) according to the loads of the gate signals GL1, GL2, . . . , GLk, . . . , GL(n−1) and GLn to output the (m−1)-th data signal DS(m−1).

The m-th data driving part 350 outputs the m-th data signal DS(m−1). The m-th data driving part 350 may include an m-th data driving circuit 351 and an m-th data signal delayer 353. The m-th data driving circuit 351 outputs an m-th original data signal ODSm. The m-th data signal delayer 353 delays the m-th original data signal ODSm according to the loads of the gate signals GL1, GL2, . . . , GLk, . . . , GL(n−1) and GLn to output the m-th data signal DSm.

Figure 5A:
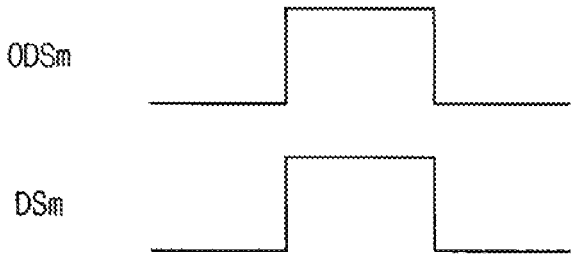
FIG. 5A is a waveform diagram illustrating an m-th original data signal and an m-th data signal of FIG. 4 when a first gate line of FIG. 1 is driven.
Figure 5B:
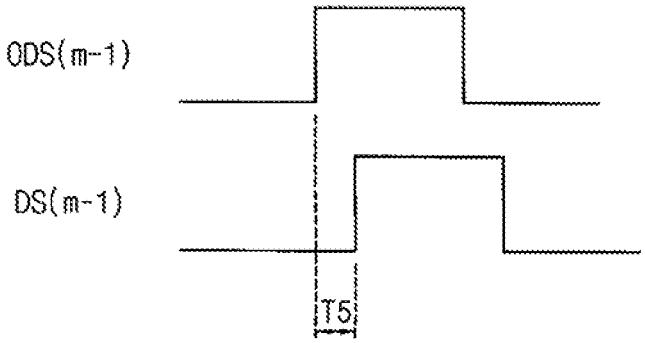
FIG. 5B is a waveform diagram illustrating an (m−1)-th original data signal and an (m−1)-th data signal of FIG. 4 when the first gate line of FIG. 1 is driven.
Figure 5C:
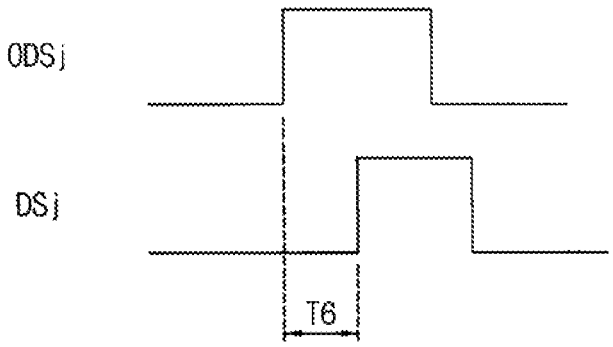
FIG. 5C is a waveform diagram illustrating a j-th original data signal and a j-th data signal of FIG. 4 when the first gate line of FIG. 1 is driven.
Figure 5D:
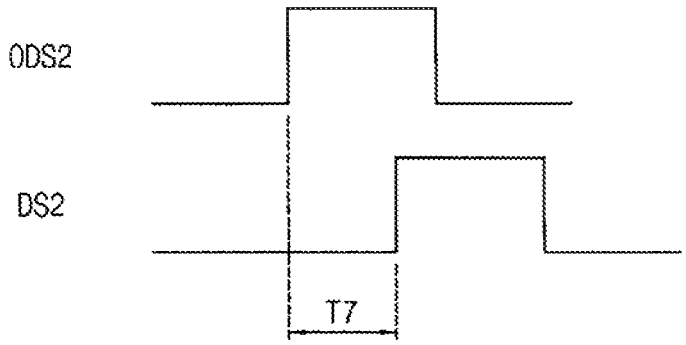
FIG. 5D is a waveform diagram illustrating a second original data signal and a second data signal of FIG. 4 when the first gate line of FIG. 1 is driven.
Figure 5E:
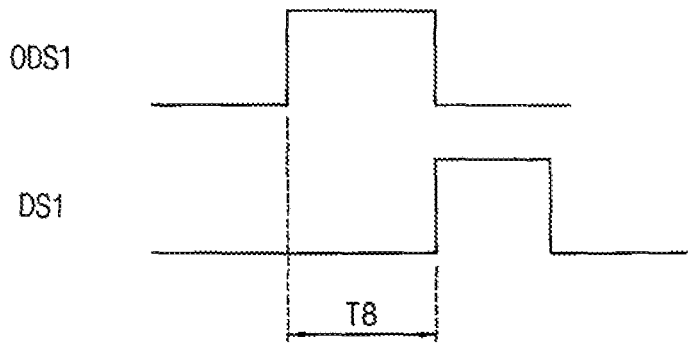
FIG. 5E is a waveform diagram illustrating a first original data signal and a first data signal of FIG. 4 when the first gate line of FIG. 1 is driven.

FIG. 5A is a waveform diagram illustrating the m-th original data signal ODSm and the m-th data signal DSm of FIG. 4 when the first gate line GL1 of FIG. 1 is driven. FIG. 5B is a waveform diagram illustrating the (m−1)-th original data signal ODS(m−1) and the (m−1)-th data signal DS(m−1) of FIG. 4 when the first gate line GL1 of FIG. 1 is driven. FIG. 5C is a waveform diagram illustrating the j-th original data signal ODSj and the j-th data signal DSj of FIG. 4 when the first gate line GL1 of FIG. 1 is driven. FIG. 5D is a waveform diagram illustrating the second original data signal ODS2 and the second data signal DS2 of FIG. 4 when the first gate line GL1 of FIG. 1 is driven. FIG. 5E is a waveform diagram illustrating the first original data signal ODS1 and the first data signal DS1 of FIG. 4 when the first gate line GL1 of FIG. 1 is driven.

Referring to FIGS. 1, 4 and 5A to 5E, when the first gate signal GS1 is applied to the first gate line GL1 and thus the first gate line GL1 is driven, the load of the first gate line GL1 increases in the second direction D2 based on the first data line DL1 adjacent to the first gate line GL1. Thus, the m-th data signal delayer 353 of the m-th data driving part 350 does not delay the m-th original data signal ODSm to output the m-th data signal DSm. Additionally, the (m−1)-th data signal delayer 343 of the (m−1)-th data driving part 340 delays the (m−1)-th original data signal ODS(m−1) by a fifth time T5 to output the (m−1)-th data signal DS(m−1). In addition, the j-th data signal delayer 333 of the j-th data driving part 330 delays the j-th original data signal ODSj by a sixth time T6 which is longer than the fifth time T5 to output the j-th data signal DSj. The second data signal delayer 323 of the second data driving part 320 delays the second original data signal ODS2 by a seventh time T7 which is longer than the sixth time T6 to output the second data signal DS2. In addition, the first data signal delayer 313 of the first data driving part 310 delays the first original data signal ODS1 by an eighth time T8 which is longer than the seventh time T7 to output the first data signal DS1.

In the present exemplary embodiment, the m-th data signal delayer 353 of the m-th data driving part 350 does not delay the m-th original data signal ODSm output from the m-th data driving circuit 351, but is not limited thereto. For example, the m-th data signal delayer 353 of the m-th data driving part 350 may delay the m-th original data signal ODSm, which is output from the m-th data driving circuit 351, by a time shorter than the fifth time T5 to output the m-th data signal DSm.

Figure 6A:
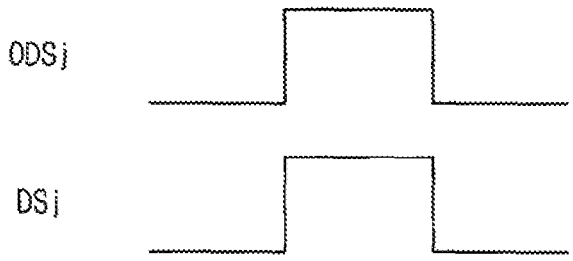
FIG. 6A is a waveform diagram illustrating the j-th original data signal and the j-th data signal of FIG. 4 when a k-th gate line of FIG. 1 is driven.
Figure 6B:
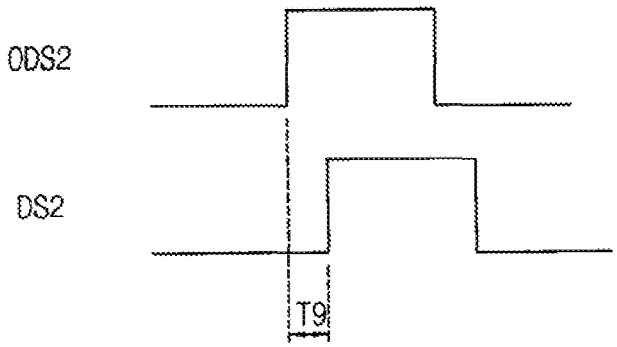
FIG. 6B is a waveform diagram illustrating the second original data signal and the second data signal of FIG. 4 when the k-th gate line of FIG. 1 is driven
Figure 6C:
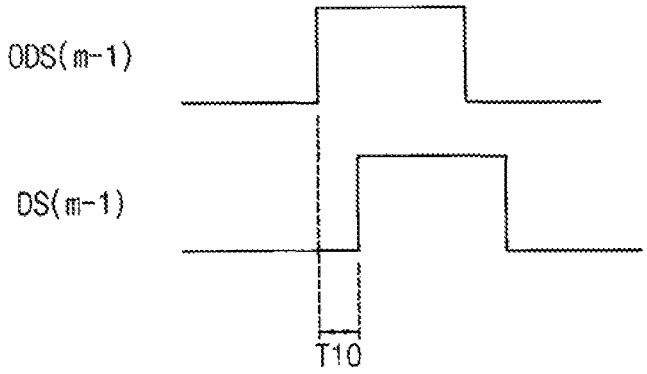
FIG. 6C is a waveform diagram illustrating the (m−1)-th original data signal and the (m−1)-th data signal of FIG. 4 when the k-th gate line of FIG. 1 is driven.
Figure 6D:
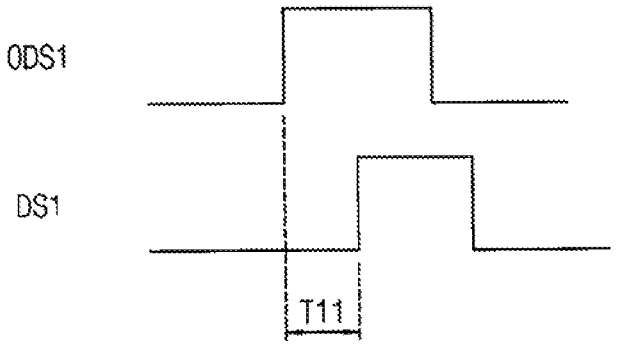
FIG. 6D is a waveform diagram illustrating the first original data signal and the first data signal of FIG. 4 when the k-th gate line of FIG. 1 is driven.
Figure 6E:
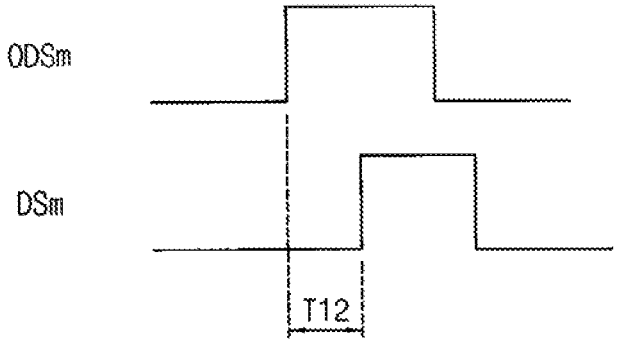
FIG. 6E is a waveform diagram illustrating the m-th original data signal and the m-th data signal of FIG. 4 when the k-th gate line of FIG. 1 is driven.

FIG. 6A is a waveform diagram illustrating the j-th original data signal ODSj and the j-th data signal DSj of FIG. 4 when the k-th gate line GLk of FIG. 1 is driven. FIG. 6B is a waveform diagram illustrating the second original data signal ODS2 and the second data signal DS2 of FIG. 4 when the k-th gate line GLk of FIG. 1 is driven. FIG. 6C is a waveform diagram illustrating the (m−1)-th original data signal ODS(m−1) and the (m−1)-th data signal DS(m−1) of FIG. 4 when the k-th gate line GLk of FIG. 1 is driven. FIG. 6D is a waveform diagram illustrating the first original data signal ODS1 and the first data signal DS1 of FIG. 4 when the k-th gate line GLk of FIG. 1 is driven. FIG. 6E is a waveform diagram illustrating the m-th original data signal ODSm and the m-th data signal DSm of FIG. 4 when the k-th gate line GLk of FIG. 1 is driven.

Referring to FIGS. 1, 4 and 6A to 6E, when the k-th gate signal GSk is applied to the k-th gate line GLk and thus the k-th gate line GLk is driven, the load of the k-th gate line GLk increases in the second direction D2 and the third direction D3 based on the j-th data line DLj adjacent to the k-th gate line GLk. Thus, the j-th data signal delayer 333 of the j-th data driving part 330 does not delay the j-th original data signal ODSj to output the j-th data signal DSj. In addition, the second data signal delayer 323 of the second data driving part 320 delays the second original data signal ODS2 by a ninth time T9 to output the second data signal DS2. In addition, the (m−1)-th data signal delayer 343 of the (m−1)-th data driving part 340 delays the (m−1)-th original data signal ODS(m−1) by a tenth time T10 to output the (m−1)-th data signal DS(m−1). The first data signal delayer 313 of the first data driving part 310 delays the first original data signal ODS1 by an eleventh time T11 which is longer than the ninth time T9 to output the first data signal DS1. In addition, the m-th data signal delayer 353 of the m-th data driving part 350 delays the m-th original data signal ODSm by a twelfth time T12 which is longer than the tenth time T10 to output the m-th data signal DSm.

In the present exemplary embodiment, the j-th data signal delayer 333 of the j-th data driving part 330 does not delay the j-th original data signal ODSj output from the j-th data driving circuit 331, but is not limited thereto. For example, the j-th data signal delayer 333 of the j-th data driving part 330 may delay the j-th original data signal ODSj, which is output from the j-th data driving circuit 331, by a time shorter than the ninth time T9 or the tenth time T10 to output the j-th data signal DSj.

Figure 7A:
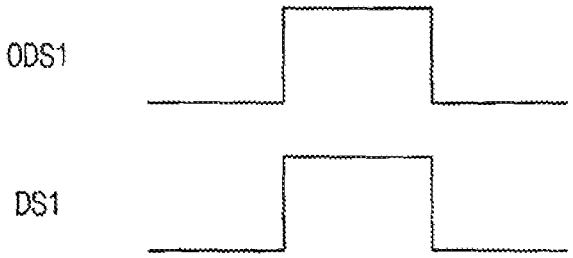
FIG. 7A is a waveform diagram illustrating the first original data signal and the first data signal of FIG. 4 when an n-th gate line of FIG. 1 is driven.
Figure 7B:
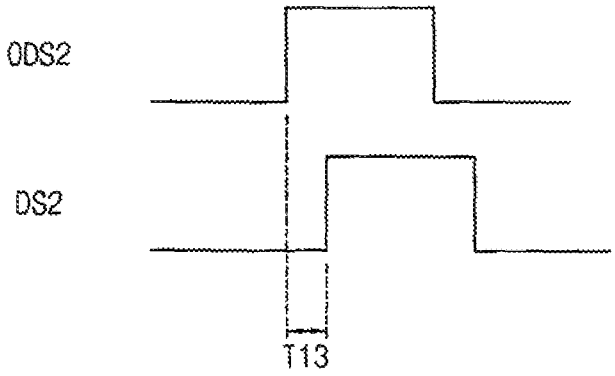
FIG. 7B is a waveform diagram illustrating the second original data signal and the second data signal of FIG. 4 when the n-th gate line of FIG. 1 is driven.
Figure 7C:
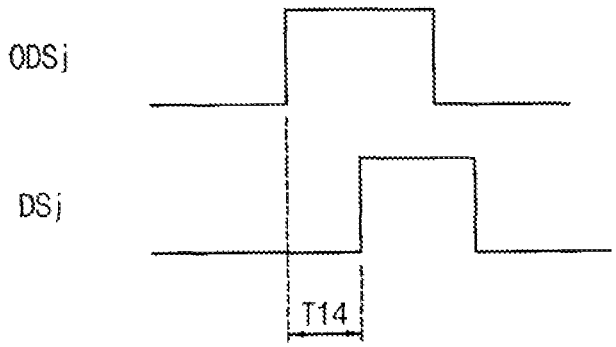
FIG. 7C is a waveform diagram illustrating the j-th original data signal and the j-th data signal of FIG. 4 when the n-th gate line of FIG. 1 is driven.
Figure 7D:
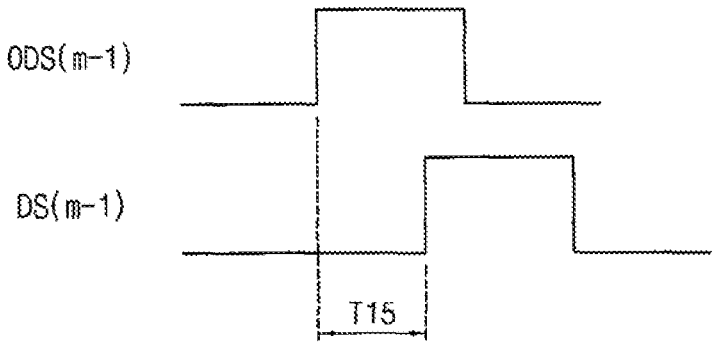
FIG. 7D is a waveform diagram illustrating the (m−1)-th original data signal and the (m−1)-th data signal of FIG. 4 when the n-th gate line of FIG. 1 is driven.
Figure 7E:
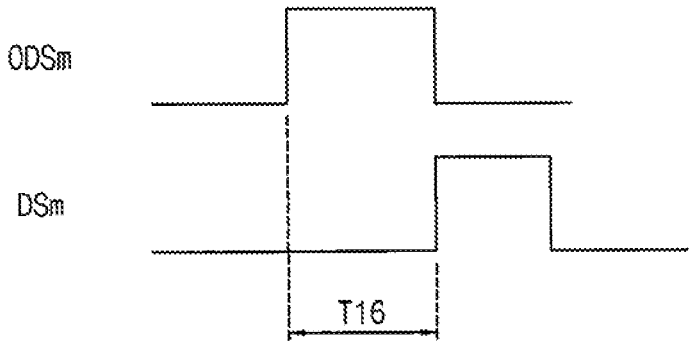
FIG. 7E is a waveform diagram illustrating the m-th original data signal and the m-th data signal of FIG. 4 when the n-th gate line of FIG. 1 is driven.

FIG. 7A is a waveform diagram illustrating the first original data signal ODS1 and the first data signal DS1 of FIG. 4 when the n-th gate line GLn of FIG. 1 is driven. FIG. 7B is a waveform diagram illustrating the second original data signal ODS2 and the second data signal DS2 of FIG. 4 when the n-th gate line GLn of FIG. 1 is driven. FIG. 7C is a waveform diagram illustrating the j-th original data signal ODSj and the j-th data signal DSj of FIG. 4 when the n-th gate line GLn of FIG. 1 is driven. FIG. 7D is a waveform diagram illustrating the (m−1)-th original data signal ODS(m−1) and the (m−1)-th data signal DS(m−1) of FIG. 4 when the n-th gate line GLn of FIG. 1 is driven. FIG. 7E is a waveform diagram illustrating the m-th original data signal ODSm and the m-th data signal DSm of FIG. 4 when the n-th gate line GLn of FIG. 1 is driven.

Referring to FIGS. 1, 4 and 7A to 7E, when the n-th gate signal GSn is applied to the n-th gate line GLn and thus the n-th gate line GLn is driven, the load of the n-th gate line GLn increases in the third direction based on the m-th data line DLm adjacent to the n-th gate line GLn. Thus, the first data signal delayer 313 of the first data driving part 310 does not delay the first original data signal ODS1 output from the first data driving circuit 311 to output the first data signal DS1. In addition, the second data signal delayer 323 of the second data driving part 320 delays the second original data signal ODS2, which is output from the second data driving circuit 321, by a thirteenth time T13 to output the second data signal DS2. In addition, the j-th data signal delayer 333 of the j-th data driving part 330 delays the j-th original data signal ODSj, which is output from the j-th data driving circuit 331, by a fourteenth time T14 which is longer than the thirteenth time T13 to output the j-th data signal DSj. In addition, the (m−1)-th data signal delayer 343 of the (m−1)-th data driving part 340 delays the (m−1)-th original data signal ODS(m−1), which is output from the (m−1)-th data driving circuit 341, by a fifteenth time T15 which is longer than the fourteenth time T15 to output the (m−1)-th data signal DS(m−1). Additionally, the m-th data signal delayer 353 of the m-th data driving part 350 delays the m-th original data signal ODSm, which is output from the m-th data driving circuit 351, by a sixteenth time T16 which is longer than the fifteenth time T15 to output the m-th data signal DSm.

In the present exemplary embodiment, the first data signal delayer 313 of the first data driving part 310 does not delay the first original data signal ODS1 output from the first data driving circuit 311, but is not limited thereto. For example, the first data signal delayer 313 of the first data driving part 310 may delay the first original data signal ODS1, which is output from the first data driving circuit 311, by a time shorter than the thirteenth time T13 to output the first data signal DS1.

According to the present exemplary embodiment, the gate driving part 200 delays the original gate signals OGS1, OGS2, . . . , OGSk, . . . , OGS(n−1) and OGSn according to the decrease of the loads of the gate lines GL1, GL2, . . . , GLk, . . . , GL(n−1) and GLn to output the gate signals GS1, GS2, . . . , GSk, . . . , GS(n−1) and GSn. In addition, the data driving part 300 outputs a delay for the original data signals ODS1, ODS2, . . . , ODSj, . . . , ODS(m−1) and ODSm according to the decrease of the loads of the gate lines GL1, GL2, . . . , GLk, . . . , GL(n−1) and GLn to output the data signals DS1, DS2, . . . , DSj, DS(m−1) and DSm. Therefore, luminance deviation of the display panel 110, which is generated by the deviation of the loads of the gate lines GL1, GL2, . . . , GLk, . . . , GL(n−1) and GLn may be decreased.

The foregoing is illustrative of the present inventive concept and is not to be construed as limiting thereof. Although a few exemplary embodiments of the present inventive concept have been described, those skilled in the art will readily appreciate that many modifications are possible in the exemplary embodiments without materially departing from the novel teachings and advantages of the present inventive concept. Accordingly, all such modifications are intended to be included within the scope of the present inventive concept as defined in the claims.

What is claimed is:

1. A display apparatus comprising:

a display panel comprising data lines extending in a first direction and arranged in a second direction substantially perpendicular to the first direction, and n gate lines including a portion extending in the first direction and a portion extending in the second direction, wherein a load on the gate lines increases from a first gate line to an n-th gate line, a data driving part including one or more data driving circuits configured to output data signals to the data lines to drive the data lines and at least one data signal delay circuit;

a gate driving part including one or more gate driving circuits configured to drive gate signals and one or more gate signal delay circuits configured to delay the gate signals by different durations as the load on the gate lines increases; and the gate driving part outputs the delayed gate signals to the n gate lines, wherein the gate driving part delays the gate signals according to a decrease of loads on the gate lines to output the gate signals to the n gate lines, and the data driving part delays data signals according to a decrease of a load to a gate line to output data signals to the data lines, wherein the gate lines includes first to n-th gate lines of which portions extending in the first direction are arranged in the second direction and the portions extending in the second direction are arranged in the first direction, wherein n is a natural number not less than five, and the portions extending in the first direction of the first to n-th gate lines increase in a sequence of the first to n-th gate lines, wherein the data lines includes a first to m-th data lines, wherein m is a natural number not less than five, the data driving part comprises a first to m-th data driving parts each respectively outputting first to m-th data signals to the first to m-th data lines, and wherein the first to m-th data driving parts respectively comprises a first to m-th data driving circuits configured to output first to m-th original data signals, and a first to m-th data signal delay circuits configured to delay the first to m-th original data signals according to the load on the gale line, wherein, an (m−1)-th data driving circuit among the first to n-th data driving circuits outputs an (m−1)-th original data signal among the first m-th original data signals, and an (m−1)-th original data signal by a fifth time to output an (m−1)-th data sign among the first to m-th data signals, a j-th data driving circuit among the first to m-th data driving circuits outputs a j-th original data signal among the first to m-th original data signals, and a j-th data signal delay circuit among the first to m-th data signal delay circuits delays the j-th original data signal by a sixth time, wherein the sixth time is longer than the fifth time and outputs a j-th data signal among the first m-th signals, wherein j is a natural number not less than three and less than (m−1), a second data driving circuit among the first to m-th data driving circuits outputs a second original data signal among the first to m-th original data signals, and a second data signal delay circuit among the first to m-th data signal delay circuits delays the second original data signal by a seventh time, wherein the seventh time is longer than the sixth time and outputs a second data signal among the first to m-th data signals, and a first data driving circuit among the first to m-th data driving circuits outputs a first original data signal among the first to m-th original data signals, and a first data signal delay circuit among the first to m-th data signal delay circuits delays the first original data signal by an eighth time, wherein the eighth time is longer than the seventh time and outputs a first data signal among the first to m-th data signals.

2. The display apparatus of claim 1, wherein portions of the n gate lines extending in the first direction are arranged sequentially in the second direction and portions of the n gate lines extending in the second direction are arranged sequentially in the first direction.

3. The display apparatus of claim 2, wherein the gate driving part includes first to n-th gate driving parts outputting first to n-th gate signals to the first to n-th gate lines, the first to (n−1)-th gate driving parts comprises a respective one of the one or more gate driving circuits arranged as first to (n−1)-th gate driving circuits outputting a first to (n−1)-th original gate signals, and first to (n−1)-th gate signal delay circuits of the one or more gate signal delay circuits configured to delay the first to (n−1)-th original gate signals, and an n-th gate driving part among the first to n-th gate driving parts comprises an n-th gate driving circuit outputting an n-th gate signal without delay by one of the one or more gate signal delay circuits.

4. The display apparatus of claim 2, wherein an (n−1)-th gate driving part among the first to (n−1)-th gate driving parts outputs an (n−1)-th original gate signal among the first to (n−1)-th original gate signals, an (n−1)-th gate signal delay circuit among the first to (n−1)-th gate signal delay circuits delays the (n−1)-th original gate signal by a first time to output an (n−1)-th gate signal among the first to n-th gate signals, a k-th gate driving part among the first to (n−1)-th gate driving parts outputs a k-th original gate signal among the first to (n−1)-th original gate signals, wherein k is a natural number not less than three and less than (n−1), and a k-th gate signal delay circuit among the first to (n−1)-th gate signal delay circuits delays the k-th original gate signal by a second time, wherein the second time is longer than the first time and outputs a k-th gate signal among the first to n-th gate signals.

5. The display apparatus of claim 4, wherein a second gate driving part among the first to (n−1)-th gate driving parts outputs a second original gate signal among the first to (n−1)-th original gate signals, and a second gate signal delay circuit among the first to (n−1)-th gate signal delay circuits delays the second original gate signal by a third time, wherein the third time is longer than the second time and outputs a second gate signal among the first to n-th gate signals.

6. The display apparatus of claim 5, wherein a first gate driving part among the first to (n−1)-th gate driving parts outputs a first original gate signal among the first to (n−1)-th original gate signals, and a first gate signal delay circuit among the first to (n−1)-th gate signal delay circuits delays the first original gate signal by a fourth time, wherein the fourth time is longer than the third time and outputs a first gate signal among the first to n-th gate signals.

7. The display apparatus of claim 1, wherein the data driving part delays original data signals according to the decrease of the load of the gate line, and outputs the data signals generated by the delay of the original data signals to the data lines.

8. The display apparatus of claim 1, wherein the portions of the gate lines extending in the first direction and the portions of the gate lines extending in the second direction of the first to n-th gate lines make contact points along a diagonal direction of the display panel.

9. The display apparatus of claim 1, wherein, when a first gate signal is applied to a first gate line among the first to n-th gate lines and the first gate line is driven, an m-th data driving circuit among the first to m-th data driving circuits outputs an m-th original data signal among the first to m-th original data signals, and an m-th data signal delay circuit among the first to m-th data signal delay circuits does not delay the m-th original data signal to output an m-th data signal among the first to m-th data signals.

10. The display apparatus of claim 1, wherein the data driving part and the gate driving part are disposed at the same side of the display panel.

11. A display apparatus comprising:

a display panel comprising data lines extending in a first direction and arranged in a second direction substantially perpendicular to the first direction, and n gate lines including a portion extending in the first direction and portion extending in the second directions, wherein a load on the gate line increases from a first gate line to an n-th gate line, a data driving part including one or more data driving circuits configured to output data signals to the data lines to drive the data lines and at least one data signal delay circuit;

a gate driving part including one or more gate driving circuits configured to drive gate signals and one or more gate signal delay circuits configured to delay the gate signals by different durations as the load on the gate lines increases; and the gate driving part outputs the delayed gate signals to the n gate lines, wherein the gate driving part delays the gate signals according to a decrease of loads on the gate liens to output the gate signal to the n gate lines, and the data driving part delays data signals according to a decrease of a load to a gate line to output data signals to the data lines, where the gate liens includes first to n-th gate lines of which the portions extending in the first direction are arranged in the second direction and the portions extending in the second direction are arranged in the first direction, wherein n is a natural number not less than five, and the portions extending in the first direction of the first to n-th gate lines increase in a sequence of the first to n-th gate lines, wherein the data lines includes a first to m-th data lines, wherein m is a natural number not less than five, the data driving part comprises a first to m-th data driving parts each respectively outputting first to m-th data signals to the first to m-th data lines, and wherein the first to m-th data driving parts respectively comprises a first to m-th data driving circuits configured to output first to m-th original data signals, and a first to m-th data signal delay circuits configured to delay the first to m-th original data signals according to the load on the gate line, wherein, when a k-th gate signal is applied to a k-th gate line among the first to n-th gate lines, wherein k is a natural number not less than three and less than (n−1), and the k-th gate line is driven, a j-th data driving circuit among the first to m-th data driving circuits outputs a j-th original data signal among the first to m-th original data signals, wherein i is a natural number not less than three and less than (m−1) and a j-th data signal delay circuit among the first to m-th data signal delay circuits does not delay the j-th original data signal to output a j-th data signal among first to m-th data signals, wherein, a second data driving circuit among the first to m-th data driving circuits outputs a second original data signal among the first to m-th original data signals, and a second data signal delay circuit among the first to m-th data signal delay circuit delays the second original data signal by a ninth time to output a second data signal among the first to m-th data signals, an (m−1)-th data driving circuit among the first to m-th data driving circuits outputs an (m−1)-th original data signal among the first to m-th original data signals, and an (m−1)-th data signal delay circuit among the first to m-th data signal delay circuit delays the (m−1)-th original data signal by a tenth time to output an (m−1)-th data signal among the first to m-th data signals, a first data driving circuit among the first to m-th data driving circuits outputs a first original data signal among the first to m-th original data signals, and a first data signal delay circuit among the first to m-th data signal delay circuit delays the first original data signal by an eleventh time, wherein the eleventh time is longer than the ninth time and outputs a first data signal among the first to m-th data signals, an m-th data driving circuit among the first to m-th data driving circuits outputs an m-th original data signal among the first to m-th original data signals, and an m-th data signal delay circuit among the first to m-th data signal delay circuit delays the m-th original data signal by a twelfth time, wherein the twelfth time is longer than the tenth time and outputs an m-th data signal among the first to m-th data signals.

12. A display apparatus comprising:

at display panel comprising data lines extending in a first direction and arranged in a second direction substantially perpendicular to the first direction, and n gate lines including a portion extending in the first direction and a portion extending in the second direction, wherein a load on the gate lines increases from a first gate line to an n-th gate line, a data driving part including one or more data driving circuits configured to output data signals to the data lines to drive the data lines and at least one data signal delay circuit:

a gate driving art including one or more gate driving circuits configured to drive gate signals and one or more gate signal delay circuits configured to delay the gate signals by different durations as the load on the gate lines increases; and the gate driving part outputs the delayed gate signals to the n gate lines, wherein the gate driving part delays the gate signals according to a decrease of loads on the gate lines to output the gate signals to the n gate lines, and the data driving part delays data signals according to a decrease of a load to a gate line to output data signals to the data lines, wherein the gate lines includes first to n-th gate lines of which the portions extending in the first direction are arranged in the second direction and the portions extending in the second direction are arranged in the first direction, wherein n is a natural number not less than five, and the portions extending in the first direction of the first to n-th gate lines increase in a sequence of the first to n-th gate lines, wherein the data lines includes a first to m-th data lines, wherein m is a natural number not less than five, the data driving part comprises a first to m-th data driving parts each respectively outputting first to m-th data signals to the first to m-th data lines, and wherein the first to m-th data driving parts respectively comprises a first to m-th data driving circuits configured to output first to m-th original data signals, and a first to m-th data signal delay circuits configured to delay the first to m-th original data signals according to the load on the gate line, wherein, when an n-th gate signal is applied to an n-th gate line among the first to n-th gate lines and the n-th gate line is driven, a first data driving circuit among the first to m-th data driving circuits outputs a first original data signal among the first to m-th original data signals, and a first data signal delay circuit among the first to m-th data signal delay circuits does not delay the first original data signal to output a first data signal among the first to m-th data signals, wherein, a second data driving circuit among the first to m-th data driving circuits outputs a second original data signal among the first to m-th original data signals, and a second data signal delay circuit among the first to m-th data signal delay circuit delays the second original data signal by a thirteenth time to output a second data signal among the first to m-th data signals, a j-th (j is a natural number not less than three and less than (m−1)) data driving circuit among the first to m-th data driving circuits outputs a j-th original data signal among the first to m-th original data signals, and a j-th data signal delay circuit among the first to m-th data signal delay circuit delays the j-th original data signal by a fourteenth time, wherein the fourteenth time is longer than the thirteenth time and outputs a j-th data signal among the first to m-th data signals, an (m−1)-th data driving circuit among the first to m-th data driving circuits outputs an (m−1)-th original data signal among the first to m-th original data signals, and an (m−1)-th data signal delay circuit among the first to m-th data signal delay circuit delays the (m−1)-th original data signal by a fifteenth time, wherein the fifteenth time is longer than the fourteenth time and outputs an (m−1)-th data signal among the first to m-th data signals, an m-th data driving circuit among the first to m-th data driving circuits outputs an m-th original data signal among the first to m-th original data signals, and an m-th data signal delay circuit among the first to m-th data signal delay circuit delays the m-th original data signal by a sixteenth time, wherein the fifteenth time is longer than the fifteenth time and outputs an m-th data signal among the first to m-th data signals.

* * * * *